US009885475B2

(12) United States Patent
Masterson et al.

(10) Patent No.: US 9,885,475 B2
(45) Date of Patent: Feb. 6, 2018

(54) WAX BURNING SYSTEM

(71) Applicant: Masterson Enterprises, Inc., Glendale Heights, IL (US)

(72) Inventors: Daniel J. Masterson, Geneva, IL (US); Dipan Surati, Palatine, IL (US); Daniel Namie, Chicago, IL (US)

(73) Assignee: Masterson Enterprises, Inc., Glendale Heights, IL (US)

( * ) Notice: Subject to any disclaimer, the term of this patent is extended or adjusted under 35 U.S.C. 154(b) by 386 days.

(21) Appl. No.: 14/661,589

(22) Filed: Mar. 18, 2015

(65) Prior Publication Data

US 2015/0192290 A1 Jul. 9, 2015

Related U.S. Application Data

(62) Division of application No. 13/640,478, filed as application No. PCT/US2009/047374 on Jun. 15, 2009, now abandoned.

(60) Provisional application No. 61/061,207, filed on Jun. 13, 2008.

(51) Int. Cl.

| | |
|---|---|
| ***F23D 3/16*** | (2006.01) |
| ***F23D 3/08*** | (2006.01) |
| ***F23D 3/18*** | (2006.01) |
| ***F23D 3/24*** | (2006.01) |

(52) U.S. Cl.

CPC ..... *F23D 3/08* (2013.01); *F23D 3/16* (2013.01); *F23D 3/18* (2013.01); *F23D 3/24* (2013.01)

(58) Field of Classification Search

CPC . C11C 5/008; C11C 5/00; C11C 5/006; F23D 3/08; F23D 2900/03082; F23D 3/16; F23D 3/24; F23D 3/18

USPC ..... 431/292–295, 298–325

See application file for complete search history.

(56) References Cited

U.S. PATENT DOCUMENTS

| | | | | | |
|---|---|---|---|---|---|
| 601,128 | A | | 3/1898 | Daily | |
| 1,327,048 | A | | 1/1920 | Kinealy | |
| 1,519,235 | A | | 12/1924 | Ayton-Blake | |
| 1,936,663 | A | | 11/1933 | Dennis | |
| 1,957,014 | A | | 5/1934 | Humpoletz | |
| 2,622,017 | A | * | 12/1952 | Bramhall | A47J 37/0768 126/9 A |
| 3,428,409 | A | | 2/1969 | Summers | |
| 4,524,408 | A | | 6/1985 | Minera | |
| 5,840,246 | A | | 11/1998 | Hammons et al. | |
| 5,967,769 | A | * | 10/1999 | Thompson | C10L 5/40 126/25 B |

(Continued)

*Primary Examiner* — Jason Lau

(74) *Attorney, Agent, or Firm* — Erickson Law Group, PC

(57) ABSTRACT

A wax burning system is disclosed. The system has a melted wax reservoir, a solid wax, a melting grate, a hollow core wick, and a wick sheath. The solid wax has a priming section. The melting grate is configured to receive the solid wax. The melting grate is located above at least a portion of the melted wax reservoir so that the solid wax melted on the melting grate is received into the melted wax reservoir. The melting grate has one or more apertures to allow a melted wax to flow through the melting grate and into the melted wax reservoir. The hollow-core wick extends above the melting grate and is configured to receive fuel from the melted wax reservoir. The priming section is located above a top of the hollow-core wick to prime the hollow-core wick for ignition. The wick sheath surrounds the hollow-core wick.

20 Claims, 8 Drawing Sheets

(56) References Cited

U.S. PATENT DOCUMENTS

| | | | | |
|---|---|---|---|---|
| 5,980,241 | A * | 11/1999 | Schirneker | C11O 5/006 362/161 |
| 6,371,756 | B1 | 4/2002 | Tooey | |
| 6,428,311 | B1 | 8/2002 | Bernardo | |
| 6,695,611 | B2 | 2/2004 | Lee | |
| 6,848,901 | B1 | 2/2005 | Matsuyama | |
| 6,857,869 | B1 * | 2/2005 | Sun | F23D 3/16 431/289 |
| 7,442,036 | B2 | 10/2008 | Kubicek | |
| 2001/0005573 | A1 * | 6/2001 | Furner | F23D 3/16 431/292 |
| 2001/0012495 | A1 * | 8/2001 | Furner | A01M 1/2088 422/126 |
| 2001/0053506 | A1 | 12/2001 | Moon | |
| 2004/0229180 | A1 * | 11/2004 | Furner | F21V 37/00 431/292 |
| 2005/0271994 | A1 * | 12/2005 | Furner | F23D 3/16 431/298 |
| 2006/0057522 | A1 | 3/2006 | Kubicek et al. | |
| 2006/0057529 | A1 * | 3/2006 | Kubicek | F23D 3/16 431/325 |
| 2006/0057530 | A1 * | 3/2006 | Kubicek | F23D 3/16 431/325 |
| 2006/0084020 | A1 * | 4/2006 | Nakatsu | C11O 5/008 431/291 |
| 2006/0084021 | A1 | 4/2006 | Kubicek | |
| 2006/0172242 | A1 * | 8/2006 | Collard | F23D 3/16 431/289 |
| 2007/0292813 | A1 * | 12/2007 | Adair | C11O 5/002 431/291 |
| 2008/0227043 | A1 * | 9/2008 | Kitt | F23D 3/26 431/292 |

* cited by examiner

WAX BURNING SYSTEM

This application is a divisional of U.S. patent application Ser. No. 13/640,478, filed Oct. 10, 2012, which is a national stage of international patent application no. PCT/US09/47374, filed Jun. 15, 2009, which claims the benefit of U.S. Provisional Patent Application No. 61/061,207, filed on Jun. 13, 2008, each of these applications are hereby incorporated by reference.

BACKGROUND OF THE INVENTION

Flaming entities like candles or torches are limited in their ability to produce a larger flame without creating a plume or a periodic wisp of soot. Similarly, larger flames tend to be high excessively high for safe indoor use, resulting in fire hazard concerns. Smaller flames produced limited light and cannot generate enough heat to sufficiently melt a solid fuel that enough or completely enough. This is especially true in wax burning products that are intended to deliver a volatile, active ingredient, like fragrance, insect repellent, aroma therapy compound, or other additives that a user desires to fill an area to perform a meaningful job like scenting a room or repelling insects.

Because a flame's ability to cast light and generate heat flux into a system relies on the flame's surface area, currently available wax burning alternatives are inadequate to offer brighter lighting without the plume of ash or soot. Traditional candles are greatly limited in their ability to shed light because of the vertical pillar nature of their flame geometry. This flame geometry quickly exceeds the professional standards for safe indoor candle use (3 inches). Even planar wicks, which can increase the length of a flame), cannot create large flames without sooting excessively. Oil lanterns (that run on liquid fuels like kerosene, mineral oil, olive oil, or other liquid fuel) can create a larger flame with a planar wick but these products will not manage heat transfer required to both melt and deliver a melted wax to the flame. Oil lanterns simply cannot tolerate solid fuels.

The limited flame surface area of traditional wax candles also creates inability to deliver enough heat to a candle or wax burning system to offset the natural cooling that tends to keep a wax solid or reforms the melted wax into a solid as the radial distance from the candle flame increase. Because of this, traditional candles fail to completely consume all of the solid wax fuel—unless the total distance from the flame is kept very small (as in a tea light). However, because the melt pool surface area remains very small, this kind of system fails to volatilize any active ingredient and deliver it to the air efficiently or completely.

Some prior art wax burning products can completely consume the sand wax fuel and create and maintain a sufficiently larger melt pool through the use of the product. However, in order to accomplish this, the products use heat conductive fins that must be placed within the flame itself to help transfer the heat of the small flame to an area that can melt and maintain the liquid wax. In doing do, the light of an already small flame is further diminished, and the aesthetics of the flame are compromised. And even so, the time to completely melt the wax fuel still approaches one hour.

Outdoor candles, even candles with larger wicks and larger flames whose flames are exposed to the natural elements, tend to be susceptible to extinguishing—even in the slightest breeze. They are also often very susceptible to the ambient temperatures. In cool air, candles take longer to develop a pool of melted wax. As the ambient temperature cools, especially below 70 degrees F., these types of traditional wax burning products produce a wax pool of much smaller diameter because of the cooling affect of the ambient air on the wax itself. These products are unable to be used and to operate as designed or intended because they are greatly dependent on ambient temperature conditions.

Presently there is no product that offers a larger flame without sooting. No product produces a flame that is resistant to extinguishing in the wind. No wax burning product works reliably in a wide range of ambient temperature conditions. No available, system can melt a solid wax fuel completely and quickly without the need to compromise the flame, as with a metal fin in the flame or an apparatus that hangs above a flame.

SUMMARY OF THE INVENTION

A wax burning system is disclosed. In one embodiment, the wax burning system has a melted wax reservoir, a solid wax, a melting grate, a hollow core wick, and a wick sheath. The solid wax has a priming section. The melting grate is configured to receive the solid wax. The melting grate is located above at least a portion of the melted wax reservoir so that the solid wax melted on the melting grate is received into the melted wax reservoir. The melting grate has one or more apertures to allow a melted wax to flow through the melting grate and into the melted wax reservoir. The hollow-core wick extends above the melting grate and receives fuel from the melted wax reservoir. The priming section is located above a top of the hollow-core wick to prime the hollow-core wick for ignition. The wick sheath surrounds the hollow-core wick.

In some embodiments, the present invention provides a solid fuel system that offers a substantially larger flame, with unique flame geometries, that can melt and manage a solid fuel to burn brighter, to burn without sooting, to resist extinguishing in a breeze, and to create a larger melt pool faster than available alternatives. In doing so, this burner apparatus sheds more light to the surroundings by creating a larger and more stable flame using a wax or solid fuel.

DETAILED DESCRIPTION OF THE INVENTION

Figure 1:
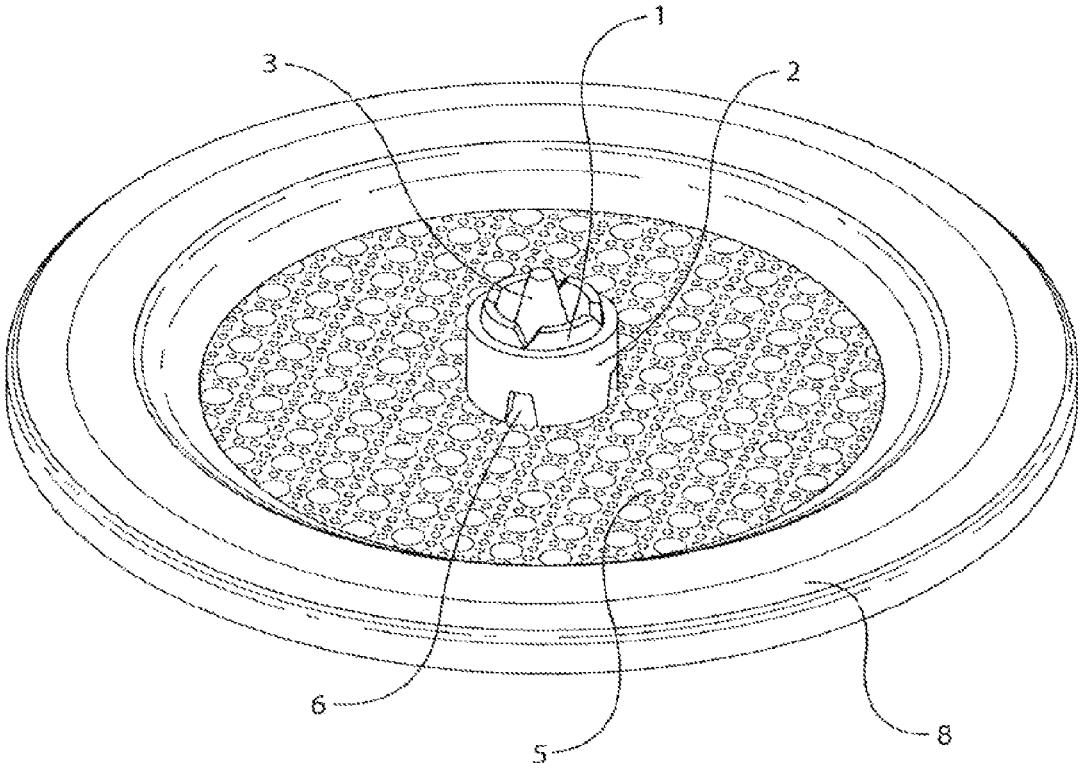
FIG. 1 is an oblique view of an embodiment of the assembly of the invention.

An example of such an apparatus is shown in FIG. 1 (full system). This version of the invention (as shown in FIG. 1) uses a novel "hollow-core" wick 1.

The hollow-core wick 1 is partially or fully cored to produce a completed or approximately completed ignition circumference. Multiple versions of the hollow-core wick 1 are shown in FIGS. 2 through 5. When lit, the space within the hollow-core wick 1 will house or stage vapor phase fuel, indicated by the presence of a white vapor cloud for paraffin fuel. Fuel in its vapor phase will balance and buffer the combustion stoichiometry of the flame above it. In this manner, then, the burner system uses less fuel than its comparable "full" wick. It also manages the fuel reaction to complete combustion and thereby produces no black wisp of soot, and creates a system that is oxygen starved, resulting in that when a breeze hits the flame, it is less likely to extinguish it. The burning system will use that excess oxygen from the breeze to stoke the flame.

The resulting flame created by the hollow-core wick 1 has a unique shape—one with a larger base section of the flame, the part of the flame that burns characteristically blue. This larger base not only results in a larger flame that sheds more light, but also provides a much larger intimate surface area to deliver heat to the surrounding area delivering heat to a heat conductive wick sheath 2 that in turn delivers heat to a heat conductive melting grate 5. Because of this larger flame and increased area of intimate connection of the larger base of the flame to the heat conductive elements of the system, the heat flux supplied to the system increases and the wax fuel held within the system melts much faster and the system delivers heat to a much larger radius from the flame, allowing for a much larger wax pool. Because of that, any volatile active ingredient held within the system is more quickly and more completely delivered to the environment.

Figure 2:
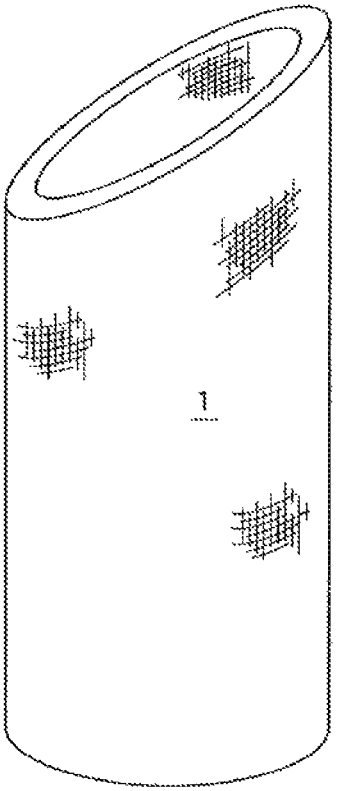
FIG. 2 is a detail drawing showing a slanted top wick embodiment.
Figure 3:
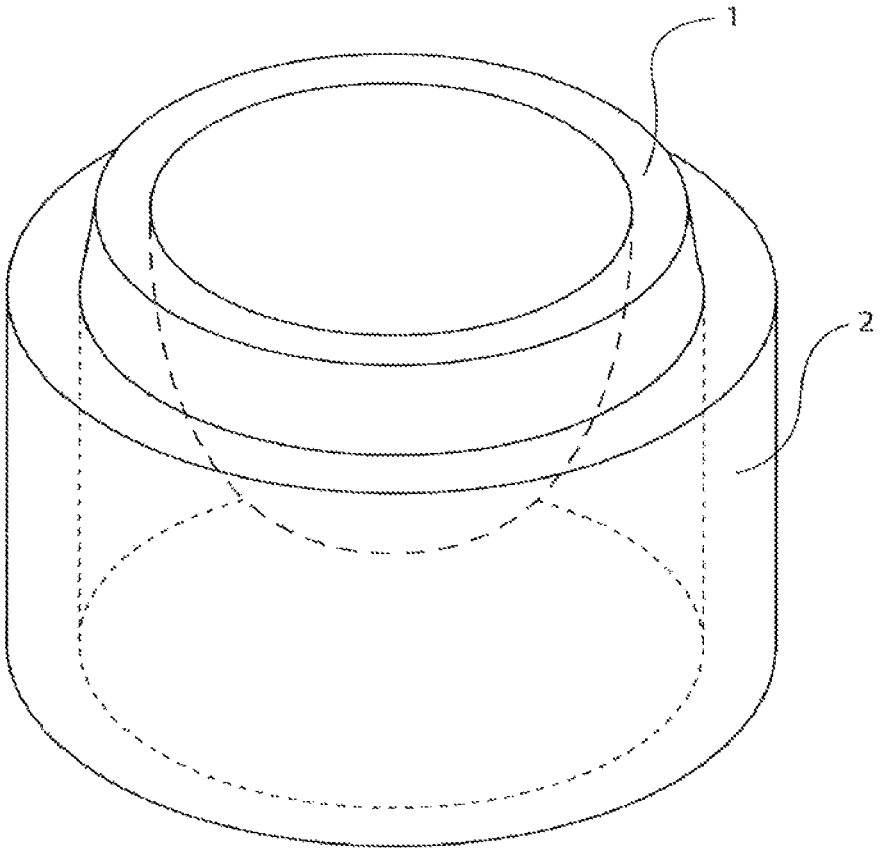
FIG. 3 is a detail drawing showing a cupped wick embodiment.

The hollow-core wick 1 need not be completely hollow, as in the cylinder model shown in FIG. 2, but will also work when the top-most portion of the wick is partially carved out, as in a cup or bowl shape. An example of a hollow-core wick 1 that is not hollow, but bowl-shaped is shown in FIG. 3. The bowl shape of the hollow-core wick 1 is preferably carved to a depth of greater than approximately ⅛ inch, such that the vapor phase fuel is created and staged within the flame.

Figure 4:
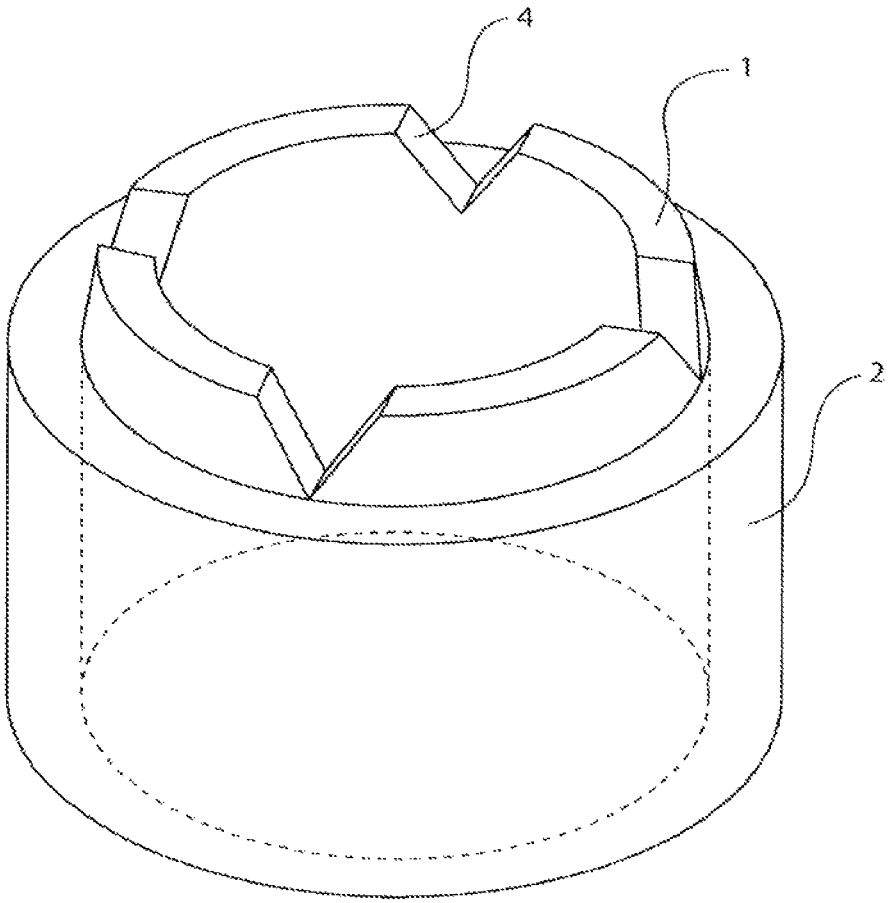
FIG. 4 is a detail drawing showing a notched wick embodiment.
Figure 5:
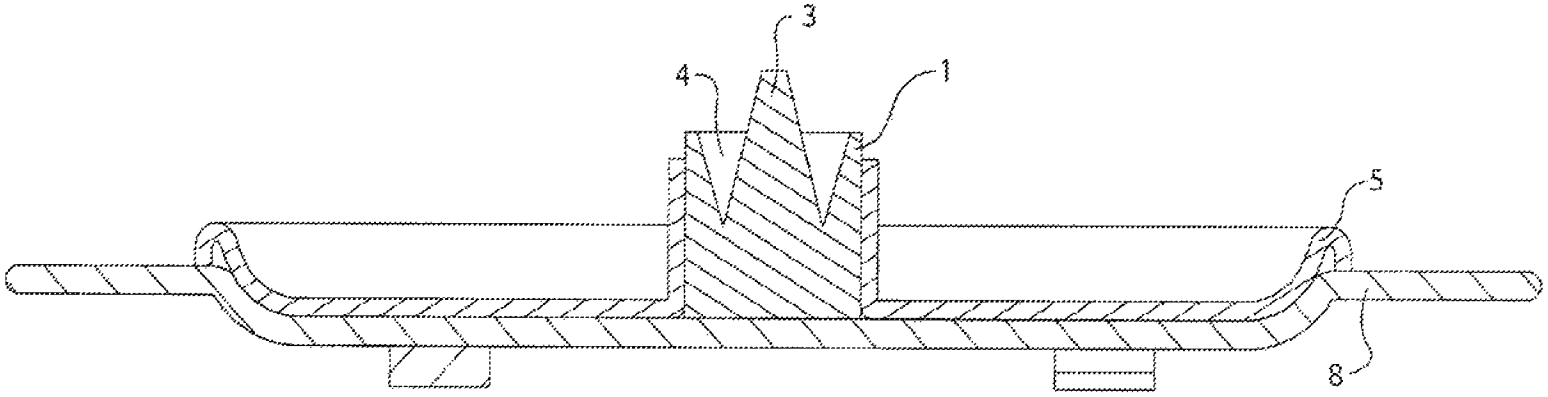
FIG. 5 is a cross section of an embodiment of the assembly of the invention.

Improvements on this hollow-core wick include:

the inclusion of a starter wick 3, as in FIGS. 1 and 4. A starter wick 3 is a smaller diameter wick, adjacent to the hollow-core wick 1 intended to reduce the total thermal mass or total heat capacity of the hollow-core wick 1 at a point where ignition is useful. It is preferred to have the starter wick 3 at the center of the hollow-core wick 1. The location of the starter wick 3 can be anywhere where the transition of the flame to the ultimate hollow-core wick 1 can be accomplished. This should generally be directly upon, or within ½ inch of the closest surface of the ultimate larger hollow-core wick 1 the circumference created by the ultimate hollow-core wick 1 can be notched or interrupted as in FIG. 1 and FIG. 4. By doing so, the ultimate hollow-core wick 1 will more readily be ignited because of the creation of smaller, non-continuous ignitable segments that have less total thermal mass or heat capacity. To the element of the flame, however, this type of hollow-core wick 1 acts as if it were completely continuous. Also, the notches 4 in the hollow-core wick 1, act to control any level of liquid fuel within the wick below the surface of the ultimate hollow-core wick 1 to prevent flooding of the larger flame and to reduce the time before the larger flame of the ultimate hollow-core wick 1 establishes itself. Finally, the presence of the notches 4 in the hollow-core wick 1 allow for improved heat transfer from the flame to the heat conductive surroundings. This happens because, the notches 4 allow for minor hot-flaring out of the hollow-core wick 1 that put the flame in intimate contact with the wick sheath 2, such that, intermittently, the system benefits from both radiation and conductive heating from the flame radiation heating by the proximity to the flame and conductive heating by thermal transfer through the heat-conducting materials.

The hollow-core wick 1 can be fashioned from any material suitable to transfer wax in its melted state. Materials like fiberglass, sintered glass, porous ceramic, porous metal, wood, and porous stone have been found to work to create the flame and sustain a flame in this type of system. A porous ceramic material has been tested to be the preferred material for the hollow-core wick 1. However, any type of material that can effectively wick melted wax and is stable in the heat of the flame can work. Generally, the ultimate hollow-core wick 1 is non-consumable; however, the starter wick 3 can be consumed by the flame and part of a refill kit, along with the fuel. The started wick 3 can also be non-consumable and part of the re-usable system.

The ultimate hollow-core wick 1 geometry can be greatly varied and thereby create any number of possible flame geometries. In general, it is preferred that the diameter of the hollow core wick 1 should not exceed about 50 times the exposed or ignited height of the exposed hollow-core wick 1. When each segment of the circumference begins to act independently of the entire hollow-core wick 1 the system can fail to create the vapor cloud of fuel that buffers the combustion stoichiometry. In other words, the spatial relationship of each segment of hollow-core wick 1 surface should not be so far away from the next available surface segment so as to prevent the vapor phase fuel from being contained within the structure of the flame. However, multiple independent wicks as described here are allowed.

The wick sheath 2 works with the hollow-core wick 1 to control the size of the flame and to act as the first conduit for heat transfer to the melting grate 5. Efficient and effective heat transfer to the melting grate 5 is needed to ensure that the flame not starve itself of fuel as the larger flame presents itself. The wick sheath 2 can be made of any heat conductive material, such as aluminum, copper, steel, and the like, and should, itself, not act as a wick. The wick sheath 2 should be of sufficient size (of cross sectional area) to accept radiation from the flame above and to not exhibit heat sink properties and to deliver enough heat to the melting grate at its bottom end. In other words, the wick sheath needs to have enough thermal mass with enough total heat capacity and ability to facilitate heat flux to allow for effective heat flux to the melting grate and any solid wax that may touch it and not so much mass as to prevent itself from getting hot enough to melt the adjacent wax and keep the large flame burning—lest the larger flame consume its supply of liquid fuel before the system has a chance to melt more.

The wick sheath 2 itself can be notched (at or near the bottom) or perforated to promote easier mass transfer of melted fuel to the base of the wick. Wick sheath notches 6 allow the fuel and oxygen to circulate in the burning system.

The wick sheath 2 preferably is in intimate thermal contact with the melting grate 5. The melting grate 5 then delivers the heat originated by the flame to the bottom surface of the solid fuel refill 7 to melt it. Unlike, the melting plate of the prior art that conducts heat to the fuel solely from one side of the heated metal, the melting grate 5 uses both sides to melt and heat the fuel used in this system. In that manner, this system melts the totality of the solid fuel faster and assists in elevating the temperature of the wax pool more quickly—this allows for faster and more complete delivery of airy volatile active ingredient to the air than other systems provide. The melting grate 5 is perforated to allow free flow of liquid fuel through and about the melting grate 5 surfaces. The perforations should not be so large as to ineffectively heat within each perforation hole crevice, to bridge the gap from one end of the hole to the centermost point from any hole surface, but should not be so small as to prevent free flow of melted fuel through the perforation holes. In general, the perforations in the melting grate 5 should preferably be no larger than approximately 1 inch in diameter and no smaller than approximately 1/64 inch in diameter for circular perforation holes. The location of the melting grate 5 should be vary close to the basin or bowl 8 that houses the system. This is done to ensure that, once melted, the fuel is kept in its molten state and is free to be delivered to the hollow-core wick 1. The melting grate 5 can be in intimate contact with the basin or bowl 8 or as far away as ½ inch from the base, so long as the melt pool remains melted. The melting grate 5 itself can be made of any heat conductive and heat stable material, such as aluminum, copper, steel, and the like.

The basin or bowl 8 can be any type of enclosure that can tolerate the heat of the system and be formed in such a way that the melted fuel finds its way by gravity to the base of the hollow-core wick 1. Materials such as glass, metal, ceramic, wood, and rock have all been used successfully.

It is preferred that the basin or bowl 8 be deep enough and wide enough to hold an adequate amount of fuel for the desired usage. Using a similar design for the basin or bowl 8 as shown in FIG. 1, the flat surface creates an additional feature in the burn characteristics. There is a spatial relationship between the outer edge of the melting grate 5 and the top of the wick sheath 2 surrounding the hollow-core wick 1. If the outer edge of the melting grate 5 is as high, or higher than the height of the wick sheath 2, the system will buffer itself from overfilling by snuffing out the larger flame at the hollow-core wick 1 and letting the fuel cool and solidify without overflowing from the bowl or basin 8. In the case where a starter wick 3 is used in the system, the flame may retreat back to only the starter wick 3, allowing the wax fuel on the melting grate 5 to cool and solidify, creating its own wax barrier away from the flame to stop spilling. The starter wick 3 will continue to burn until it consumes enough of the excess was fuel to re-light the larger, hollow-core wick 1, which then will again warm the melting grate 5 to re-melt the wax fuel and resume consuming the burn to completion.

The basin or bowl 8 may be closed on the top to prevent spillage of fuel or contact with hot fuel or other surfaces. In a closed model, the top may sit on the basin or bowl 8 or may be attached, including by screwing onto the basin or bowl 8.

Figure 6:
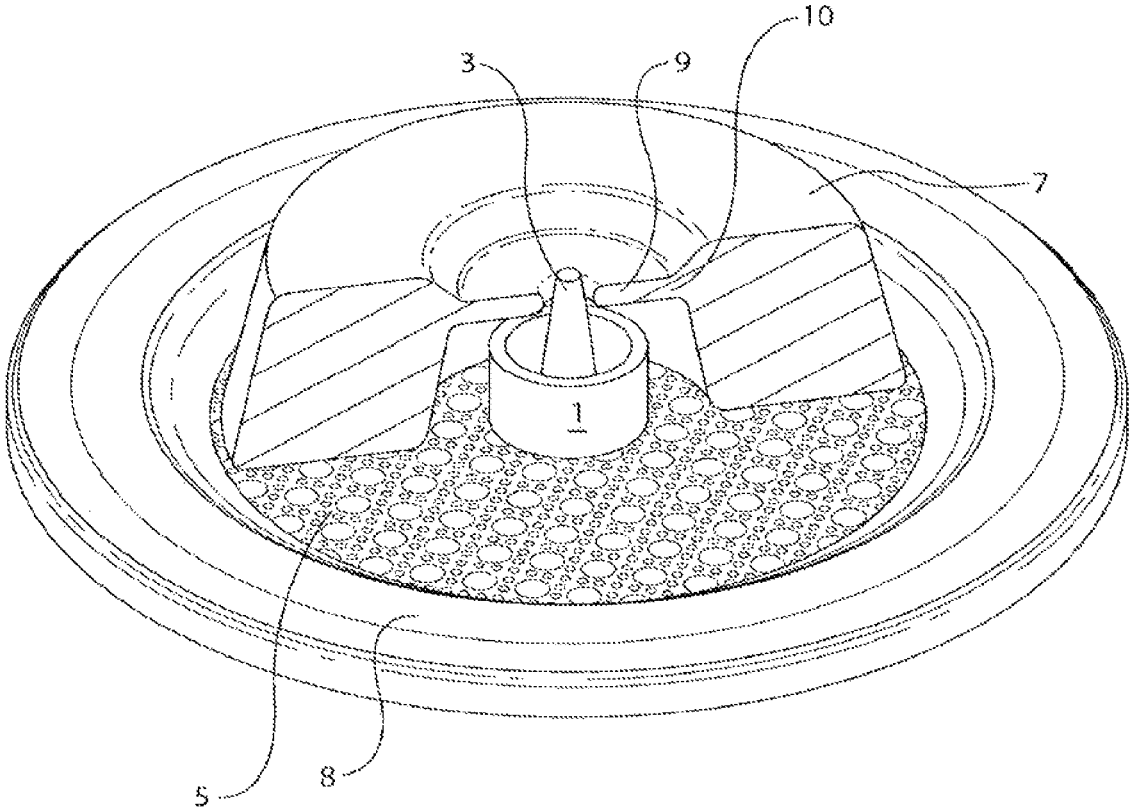
FIG. 6 is an oblique view of an embodiment of the assembly of the invention with a cut-away view showing one half of a wax refill assembly embodiment.
Figure 7:
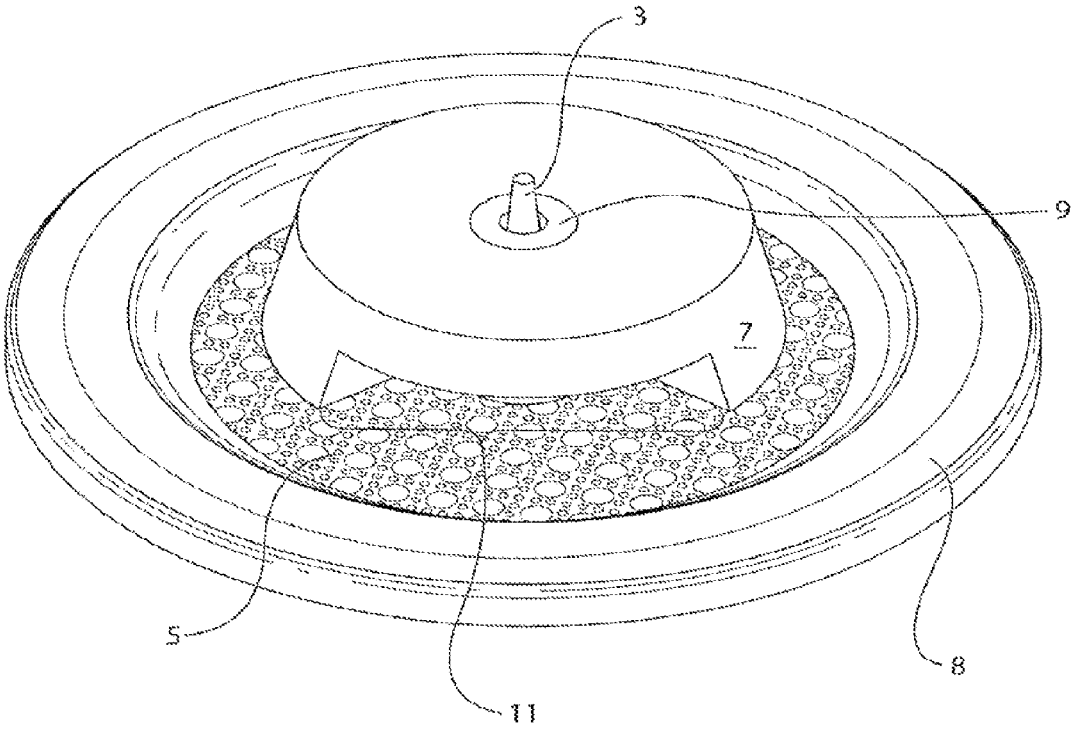
FIG. 7 is an oblique view of an embodiment of the assembly of the invention with an elevated wax refill assembly embodiment.
Figure 8:
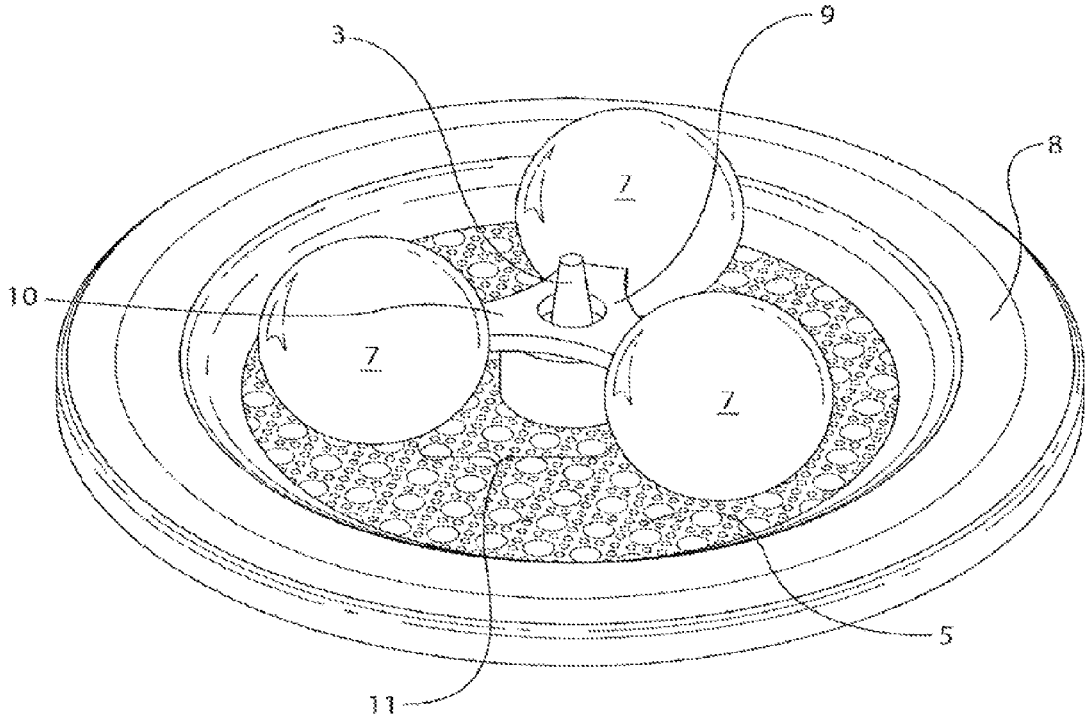
FIG. 8 is an oblique view of an embodiment of the assembly of the invention with a tri-pod refill.

The solid fuel refill 7 can be in either a pellet form or a pre-formed solid element, as shown in FIGS. 6-8. The pre-formed may be greatly preferred by some users because it is preferential to have a refill formed with the following attributes (see FIGS. 6 though 8):

The solid fuel refill 7 preferably has a priming section 9 to prime the hollow-core wick 1 or starter wick 3. This priming section 9 is melted by the heat of a flame from a match, lighter or the like, and the melted fuel then flows toward the hollow-core wick 1 or starter wick 3. This priming section 9 is also small enough in total mass as to begin to melt away from the hollow-core wick or starter wick 3 after a brief period of priming, so as to allow the primed hollow-core wick 1 or starter wick 3 to reach ignition temperatures quickly.

The solid fuel refill 7 preferably has a striking section 10 that manages to fill or approximately fill the lower section of the hollow-core wick 1 with melted fuel. This melted fuel should be sufficient to allow the larger flame, once lit, to stay lit long enough to raise the temperature of the wick sheath 2 and its immediate surroundings, including the first radial portion of the melting grate 5 above the melt transition temperature range of the solid fuel. This fuel should be less than the amount needed to flood the flame.

The solid fuel refill 7 preferably has additional reservoir sections that make up the bulk of the solid fuel refill 7 and are used to keep the system burning for the desired period of time.

The solid fuel refill 7 preferably is made in a geometric shape that allows for free flow of melting fuel from the additional reservoir sections, beneath the uppermost surface of the wick sheath 2 and even away from the hollow-core wick 1 assembly. This can be done by opening a portion of the radius 11 or creating a solid fuel refill 7 that, when fully melted, does not reach the top of the wick sheath 2. This requirement is preferred but may not be necessary for the system to work if a starter wick 3 is used. With this requirement, the system with the starter wick 3 will transition to, and stay in, the large flame state—creating the fastest melt pool development and delivering a volatile active ingredient faster and more completely. Otherwise, the system will flood the large flame after enough solid fuel melts to cover the periphery of the ultimate hollow-core wick 1—maintaining the smaller flame with the starter wick 3 until enough fuel is consumed to allow the rest of the ultimate hollow-core wick 1 to present itself. The system will still work with this cycling between large and small flame but will take longer to melt all of the fuel. A potential option for this is for a solid fuel refill 7 to be designed that when used in one direction, as shown in FIG. 8, offers fast volatile ingredient delivery and, when used upside down, offers a longer burn time.

In using a pellet form for the fuel, the pellets could be poured into the basin or bowl 8 to be incorporated into the melt pool of melted fuel. The addition of more pellets could even be done while the flame is burning.

While particular elements, embodiments, and applications of the present invention have been shown and described, the invention is not limited thereto because modifications may be made by those skilled in the art, particularly in light of the foregoing teaching. It is therefore contemplated by the application to cover such modifications and incorporate those features which come within the spirit and scope of the invention.

The invention claimed is:

1. A wax burning system, comprising:

a melted wax reservoir;

a solid wax, the solid wax comprises a priming section;

a melting grate configured to receive the solid wax, the melting grate located above at least a portion of the melted wax reservoir so that the solid wax melted on the melting grate is received into the melted wax reservoir, the melting grate comprising one or more apertures to allow a melted wax to flow through the melting grate and into the melted wax reservoir;

a hollow-core wick extending above the melting grate and configured to receive fuel from the melted wax reservoir, the hollow-core wick comprises a hollow core and an upper exit opening in communication with the hollow core;

the priming section is cantilevered over a top surface of the hollow-core wick to prime the hollow-core wick for ignition; and, a wick sheath surrounding the hollow-core wick.

2. The wax burning system of claim 1, wherein the wick sheath is in contact with the melting grate to transfer a heat from the flame on the hollow-core wick to the melting grate, where the melting grate radiates the heat upward to melt the solid wax on the melting grate and downward towards the melted wax reservoir to maintain the melted wax within the reservoir in a melted state.

3. The wax burning system of claim 1, wherein the priming section is positioned over the top surface of the hollow-core wick in a manner so that when the priming section is melted the melted wax flows toward the hollow-core wick.

4. The wax burning system of claim 1, wherein at least a portion of the priming section is located directly over a top surface of the hollow-core wick.

5. The wax burning system of claim 1, wherein the solid wax comprises a stoking section and a main section; a portion of the main section is located on the melting grate and supports the stoking section and the priming section above the melting grate.

6. The wax burning system of claim 1, wherein the solid wax comprises a stoking section and a main section; the stoking section is adjacent the top surface of the hollow-core wick and the main section is adjacent the wick.

7. The wax burning system of claim 1, wherein the priming section is located over an entirety of a top of the hollow-core wick.

8. The wax burning system of claim 1, wherein the solid wax surrounds the hollow-core wick and is spaced apart from the hollow-core wick.

9. The wax burning system of claim 1, wherein the solid wax comprises a main section; the main section comprises main portions spaced about the hollow-core wick, one or more gaps exist between adjacent main portions providing access to the hollow-core wick.

10. The wax burning system of claim 1, wherein the hollow-core wick comprises a perimeter wall defining the hollow core, the solid wax surrounds an entirety of the perimeter wall.

11. The wax burning system of claim 1, wherein the hollow core of the hollow-core wick has a hollowed-out depth that is at least ⅛ of an inch from a top surface of the wick.

12. The wax burning system of claim 1, wherein the wick sheath contains apertures to allow for air entry into a core of the hollow-core wick through a porous sidewall of the hollow-core wick, the apertures are oriented transverse to the hollow core of the hollow-core wick.

13. The wax burning system of claim 1, wherein the hollow-core wick comprises the top surface adjacent to the flame and a bottom end for receiving liquid fuel and a heat flux through or about the hollow-core wick is sufficient to create and maintain a liquid fuel for transport through the hollow-core wick.

14. The wax burning system of claim 1, wherein the hollow-core wick has a bottom end, the bottom end does not extend below the melting grate.

15. The wax burning system of claim 1, wherein the hollow-core wick comprises a wick diameter for staging vapor phase fuel below a flame on the hollow-core wick adjacent the upper exit opening to create a partially oxygen deprived condition at the flame on the wick, the wick diameter does not exceed fifty times an exposed height of the hollow-core wick above the wick sheath.

16. The wax burning system of claim 1, wherein the hollow core of the hollow-core wick extends through an entirety of the hollow-core wick from the top to a bottom end of the hollow-core wick.

17. The wax burning system of claim 1, wherein, the solid wax comprises a stoking section and a main section, the stoking section is adjacent the priming section, and the main fuel section is adjacent the stoking section;

at least a portion of the priming section is located directly over the top surface of the hollow-core wick;

the main section is configured to be located on the melting grate and to support the stoking section and the priming section above the melting grate;

the priming section is positioned so that when the priming section is melted the melted wax flows toward the hollow-core wick;

the hollow core of the hollow-core wick has a hollowed-out depth that is at least ⅛ of an inch from a top surface of the wick;

the solid wax is removable from the melting grate;

the heat conductive wick sheath contains apertures to allow for air entry into a core of the hollow-core wick through a porous sidewall of the hollow-core wick, the apertures are oriented transverse to the hollow core of the hollow-core wick; and, the hollow-core wick has a bottom end, the bottom end does not extend below the melting grate.

18. The wax burning system of claim 17, wherein, the heat conductive wick sheath comprises one or more liquid fuel exchange openings in a lower portion of the wick sheath;

the hollow core wick comprises a wick diameter, the wick diameter does not exceed fifty times an exposed height of the hollow-core wick above the wick sheath;

the hollow-core wick comprises at least one notch on the top of the wick; and, the stoking section is configured to stoke a flame on the hollow-core wick while the wax burning system increases in temperature, and the main fuel section is configured to maintain the flame on the hollow-core wick until substantially all of the fuel is consumed.

19. A wax burning system, comprising:

a melted wax reservoir;

a solid wax, the solid wax comprises a priming section, a stoking section, and a main section, the stoking section is adjacent the priming section, and the main section is adjacent the stoking section;

a melting grate configured to receive the solid wax, the melting grate located above at least a portion of the melted wax reservoir so that the solid wax melted on the melting grate is received into the melted wax reservoir, the melting grate comprising one or more apertures to allow a melted wax to flow through the melting grate and into the melted wax reservoir;

a wick extending above the melting grate and configured to receive fuel from the melted wax reservoir, the wick comprises a hollow core and an upper exit opening in communication with the hollow core;

the solid wax is shaped to position the priming section cantilevered over a top surface of the wick to prime the wick for ignition, the main section supporting the priming section above the melting grate and cantilevered over the top surface of the wick; and, a wick sheath surrounding the wick.

20. The wax burning system of claim 19, wherein, the wick sheath is in contact with the melting grate to transfer a heat from the flame on the hollow-core wick to the melting grate, where the melting grate radiates the heat upward to melt the solid wax on the melting grate and downward towards the melted wax reservoir to maintain the melted wax within the reservoir in a melted state; and, at least a portion of the priming section is located directly over the top surface of the wick.

* * * * *